US012435904B2

(12) United States Patent
Liu et al.

(10) Patent No.: US 12,435,904 B2
(45) Date of Patent: Oct. 7, 2025

(54) AIR CONDITIONER INDOOR UNIT AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Qiwei Liu, Guangdong (CN); Fuxing Zhai, Guangdong (CN); Jian He, Guangdong (CN); Zhengqing Yi, Guangdong (CN); Shaosheng Guo, Guangdong (CN); Peng Xie, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 562 days.

(21) Appl. No.: 17/740,866

(22) Filed: May 10, 2022

(65) Prior Publication Data

US 2022/0268481 A1 Aug. 25, 2022

Related U.S. Application Data

(63) Continuation of application No. PCT/CN2020/127805, filed on Nov. 10, 2020.

(30) Foreign Application Priority Data

Nov. 13, 2019 (CN) ..... 201911108246.X
Nov. 13, 2019 (CN) ..... 201921961260.X

(51) Int. Cl.
*F24F 13/14* (2006.01)
*F24F 1/0014* (2019.01)

(52) U.S. Cl.
CPC ..... *F24F 13/1413* (2013.01); *F24F 1/0014* (2013.01)

(58) Field of Classification Search
CPC ..... F24F 13/1413; F24F 13/14; F24F 1/0014; F24F 2013/1446; F24F 11/65; F24F 11/67
(Continued)

(56) References Cited

U.S. PATENT DOCUMENTS

2016/0363343 A1* 12/2016 Okamoto ..... F24F 1/0057
2017/0176026 A1* 6/2017 Lee ..... F24F 1/0011
(Continued)

FOREIGN PATENT DOCUMENTS

CN 204478263 U 7/2015
CN 105509285 A 4/2016
(Continued)

OTHER PUBLICATIONS

Extended European Search Report dated Nov. 23, 2022 received in European Patent Application No. EP 20887280.4.
(Continued)

*Primary Examiner* — Steven B McAllister
*Assistant Examiner* — Charles R Brawner
(74) *Attorney, Agent, or Firm* — Scully, Scott, Murphy & Presser, P.C.

(57) ABSTRACT

An air conditioner indoor unit and an air conditioner are provided. The indoor unit has a surface frame, a breezeless member, a heat exchanger and a fan. A first air outlet is formed in a front lower part of the surface frame. At least one second air outlet is formed on at least one of a left side of the surface frame and a right side of the surface frame. The breezeless member is disposed on a front side of the surface frame and movable between a first position and a second position. When the breezeless member is located at the first position, the first panel opens the first air outlet.
(Continued)

When the breezeless member is located at the second position, the first panel closes the first air outlet.

22 Claims, 13 Drawing Sheets

(58) Field of Classification Search
USPC ..... 454/233
See application file for complete search history.

(56) References Cited

U.S. PATENT DOCUMENTS

| | | | | |
|---|---|---|---|---|
| 2019/0003727 | A1 | 1/2019 | Kim et al. | |
| 2021/0018186 | A1* | 1/2021 | Bae | F24F 1/005 |

FOREIGN PATENT DOCUMENTS

| | | | | |
|---|---|---|---|---|
| CN | 106287938 | A | 1/2017 | |
| CN | 106642310 | A | 5/2017 | |
| CN | 107314454 | A | 11/2017 | |
| CN | 107741052 | A | 2/2018 | |
| CN | 107741057 | A | 2/2018 | |
| CN | 207073927 | U | 3/2018 | |
| CN | 108006822 | A | 5/2018 | |
| CN | 108006823 | A | 5/2018 | |
| CN | 110319563 | A | 10/2019 | |
| CN | 110319565 | A | 10/2019 | |
| CN | 110319569 | A | 10/2019 | |
| CN | 209459173 | U | 10/2019 | |
| CN | 110701683 | A | 1/2020 | |
| CN | 210861385 | U | 6/2020 | |
| CN | 210861625 | U | 6/2020 | |
| CN | 210891910 | U | 6/2020 | |
| CN | 211119679 | U | 7/2020 | |
| JP | 5194910 | B2 | 5/2013 | |
| JP | 5588533 | B2 | 9/2014 | |
| JP | 2016-70110 | A | 5/2016 | |
| WO | 2013001823 | A1 | 1/2013 | |
| WO | WO-2017101671 | A1 * | 6/2017 | |
| WO | WO-2019024821 | A1 * | 2/2019 | F24F 1/0025 |

OTHER PUBLICATIONS

International Search Report dated Feb. 18, 2021 received in International Application No. PCT/CN2020/127805.

Chinese Office Action and Search Report dated Jun. 12, 2024 received in Chinese Application No. 201911108246.X together with an English-language translation.

* cited by examiner

AIR CONDITIONER INDOOR UNIT AND AIR CONDITIONER

CROSS-REFERENCE TO RELATED APPLICATIONS

This application is a continuation application of PCT International Patent Application No. PCT/CN2020/127805, filed on Nov. 10, 2020, which claims priority to and benefits of the Chinese Patent Applications Nos. 201911108246.X and 201921961260.X, filed on Nov. 13, 2019, the entire contents of which are incorporated herein by reference for all purposes. No new matter has been introduced.

FIELD

The present disclosure relates to the field of air conditioning device, and more particularly, to an air conditioner indoor unit and an air conditioner.

BACKGROUND

In the related art, the air conditioner indoor unit has a small air output volume and a low cooling and heating efficiency due to structural limitations.

SUMMARY

The present disclosure aims to solve at least one of the technical problems existing in the prior art. To this end, the present disclosure proposes an air conditioner indoor unit, which can realize multi-angle air output and large air output volume, realize rapid cooling and heating, and improve the working efficiency of the air conditioner indoor unit.

The present disclosure further proposes an air conditioner having the above air conditioner indoor unit.

According to an embodiment of the present disclosure in a first aspect, the air conditioner indoor unit includes: a surface frame having an air inlet formed thereon, having a first air outlet formed in a front lower part of the surface frame, and having a second air outlet formed on at least one of a left side of the surface frame and a right side of the surface frame, the first air outlet penetrating forward through a front part of the surface frame and the first air outlet penetrating downward through a bottom part of the surface frame; a breezeless member disposed on a front side of the surface frame and movable between a first position and a second position, the breezeless member including a first panel; and a heat exchanger and a fan that are disposed in the surface frame. When the breezeless member is located at the first position, the first panel opens the first air outlet. When the breezeless member is located at the second position, the first panel closes the first air outlet.

According to the air conditioner indoor unit of the present disclosure, the first air outlet is formed at the front part of the surface frame and the first air outlet penetrates through the bottom part of the surface frame, and the second air outlet is formed on at least one of the left side of the surface frame and the right side of the surface frame, which can realize multi-angle air output, increase the air output volume and the air output range, realize rapid cooling and heating, and improve the working efficiency of the air conditioner indoor unit.

According to some embodiments of the present disclosure, the breezeless member is disposed on the front side of the surface frame and movable up and down between the first position and the second position.

According to some embodiments of the present disclosure, when the breezeless member is located at the second position, the first panel has an air dispersing structure formed in a part thereof opposite to the first air outlet.

According to some embodiments of the present disclosure, the surface frame has a second panel provided on an upper end thereof and located on the front side of the surface frame, an accommodating cavity is defined between the second panel and the surface frame, and when the breezeless member is located at the second position, at least a part of the first panel is located in the accommodating cavity.

Optionally, the first panel includes an air output portion having an air dispersing structure formed thereon, and when the breezeless member is located at the second position, the air output portion is opposite to the first air outlet.

Optionally, the first panel includes a non-air output portion and an air output portion that are connected to each other up and down, the air output portion has an air dispersing structure formed thereon, and the non-air output portion is located above the air output portion, and when the breezeless member is located at the second position, the air output portion is opposite to the first air outlet, and the non-air output portion is located in the accommodating cavity.

Further, the breezeless member includes an air dispersing module having an air dispersing function, and the air dispersing module is disposed on the air output portion and located at an inner side of the air output portion.

Further, the air dispersing module includes a mounting plate having a plurality of first vent holes formed therein and arranged in a left and right direction. The mounting plate is connected to the first panel.

Further, the air dispersing module includes an air dispersing mechanism with an air dispersing function, and the air dispersing mechanism is disposed at the plurality of first vent holes.

Further, the air dispersing mechanism includes a guide vane assembly disposed in each of the plurality of first vent holes, and the guide vane assembly includes a stationary blade and a rotatable moving blade that are arranged along an axial direction of the first vent hole.

Optionally, the moving blade is disposed on a front side or a rear side of the stationary blade.

Optionally, the moving blade and the stationary blade are disposed coaxially.

According to some optional embodiments of the present disclosure, the air dispersing module includes a limit plate connected to the first panel, and the limit plate is disposed on a front side of the mounting plate and is connected to the mounting plate, the limit plate has second vent holes formed therein and opposite to and in communication with the plurality of first vent holes, and an accommodating cavity is defined between the mounting plate and the limit plate and is adapted to accommodate the air dispersing mechanism.

According to some embodiments of the present disclosure, the air output portion includes a first sub air output portion and a second sub air output portion that are connected to each other up and down, each of the first sub air output portion and the second air output portion has the air dispersing structure formed thereon, an included angle is defined between the first sub air output portion and the second sub air output portion, an air dispersing module is disposed on the first sub air output portion, and when the breezeless member is located at the second position, the first sub air output portion is located on a front side of the first air outlet, and the second sub air output portion is located at a bottom part of the first air outlet.

According to some optional embodiments of the present disclosure, the air output portion includes a first sub air output portion and a second sub air output portion that are connected to each other up and down, and each of the first sub air output portion and the second sub air output portion has the air dispersing structure formed thereon, an included angle is defined between the first sub air output portion and the second sub air output portion, and when the breezeless member is located at the second position, the first sub air output portion is located on a front side of the first air outlet, and the second sub air output portion is located at a bottom part of the first air outlet.

Further, the included angle between the first sub air output portion and the second sub air output portion ranges from 60° to 120°.

According to some embodiments of the present disclosure, the surface frame has an air outlet channel therein that is in communication with both the first air outlet and the second air outlet, and a guide portion is formed on a part of a bottom wall of the air outlet channel adjacent to the first air outlet, and the guide portion is used to guide airflow toward the first air outlet.

Further, in a rear-to-front direction, the guide portion extends obliquely and downward to guide a part of the airflow to a bottom part of the first air outlet.

According to some optional embodiments of the present disclosure, an included angle between the guide portion and a vertical direction ranges from 15° to 60°.

Further, the bottom wall of the air outlet channel has a part thereof on a side of the guide portion away from the first air outlet as a flow guide portion, and the included angle between the guide portion and the vertical direction is smaller than an included angle between the flow guide portion and the vertical direction.

According to some optional embodiments of the present disclosure, when the breezeless member is located at the second position, the guide portion is opposite to or abuts against a bottom part of the first panel in a front and rear direction.

According to some embodiments of the present disclosure, the surface frame has an air outlet channel therein that is in communication with both the first air outlet and the second air outlet, and a rotatable inner air guide plate is disposed in the air outlet channel.

Optionally, the air conditioner indoor unit has a heating mode and a cooling mode; when the breezeless member is located at the first position and the air conditioner indoor unit is in the cooling mode, an included angle between the inner air guide plate and a horizontal plane ranges from 0 to 45'; and when the breezeless member is located at the first position and the air conditioner indoor unit is in the heating mode, the included angle between the inner air guide plate and the horizontal plane ranges from 45° to 90°.

Optionally, a length of the inner air guide plate in an air outlet direction of the first air outlet is adjustable.

According to some optional embodiments of the present disclosure, when the breezeless member is located at the first position, the length of the inner air guide plate in the air outlet direction of the first air outlet is L1, and when the breezeless member is located at the second position, the length of the inner air guide plate in the air outlet direction of the first air outlet is L2, where L2 is smaller than L1.

According to some optional embodiments of the present disclosure, the inner air guide plate includes a first sub inner air guide plate rotatably connected to an inner wall of the air outlet channel; and a second sub inner air guide plate movably disposed on the first sub inner air guide plate to adjust the length of the inner air guide plate in the air outlet direction of the first air outlet.

Further, the second sub inner air guide plate is slidable or rotatable relative to the first sub inner air guide plate.

Further, a sliding cavity is defined in the first sub inner air guide plate, and the second sub inner air guide plate is slidably disposed in the sliding cavity.

According to some embodiments of the present disclosure, the surface frame has an air outlet channel therein that is in communication with both the first air outlet and the second air outlet, and when the breezeless member is located at the first position, a bottom part of the first panel is adapted to abut against a top wall of the air outlet channel.

According to some embodiments of the present disclosure, a driving mechanism for driving the breezeless member to move includes: a motor disposed on a chassis or the surface frame of the air conditioner indoor unit; a gear connected to an output shaft of the motor; and a rack disposed on the breezeless member and extending in an up and down direction, the rack being adapted to engage with the gear.

Optionally, the rack is disposed on the first panel, and the rack is detachably connected to the first panel or the rack is integrally formed with the first panel.

Optionally, a first guide rail is disposed on one of the chassis and the breezeless member, and a second guide rail is disposed on the other of the chassis and the breezeless member and is matched with the first guide rail; or the first guide rail is disposed on one of the surface frame and the breezeless member, and the second guide rail is disposed on the other of the surface frame and the breezeless member and is matched with the first guide rail.

Further, a motor mounting base is disposed on the chassis or the surface frame, the motor is disposed on the motor mounting base, the first guide rail is disposed on the motor mounting base, and the second guide rail is disposed on the rack.

Further, a matching cavity with an open front side is formed on the motor mounting base, at least a part of the gear is located in the matching cavity, a part of the rack extends into the matching cavity and engages with the gear, the second guide rail includes guide grooves formed on a left side wall and a right side wall of the rack, the first guide rail includes guide protrusions formed on a left side wall and a right side wall of an open end of the matching cavity, and each of the guide protrusions fits in a corresponding one of the guide grooves and is slidable up and down relative to the corresponding guide groove.

According to some optional embodiments of the present disclosure, the rack includes a tooth holder, the tooth holder having a tooth portion and a non-tooth portion on a surface thereof facing towards the gear, the tooth portion extends in an up and down direction and is adapted to engage with the gear, and the non-tooth portion is located on at least one side of a length direction of the tooth portion.

According to an embodiment of the present disclosure in a second aspect, an air conditioner includes: the air conditioner indoor unit according to any of the embodiments of the present disclosure in the first aspect.

According to the air conditioner of the present disclosure, the above air conditioner indoor unit is provided, which can discharge air from multiple angles and the air output volume is large, so that the air conditioner can discharge air from multiple angles, the air output volume and the air output range of the air conditioner can be improved, and the working efficiency of the air conditioner can be improved.

Additional aspects and advantages of the present disclosure will be set forth, in part, from the following description, and in part will become apparent from the following description, or may be learned by practice of the present disclosure.

BRIEF DESCRIPTION OF DRAWINGS

The above and/or additional aspects and advantages of the present disclosure will become apparent and readily understood from the following description of embodiments in conjunction with the accompanying drawings.

Figure 1:
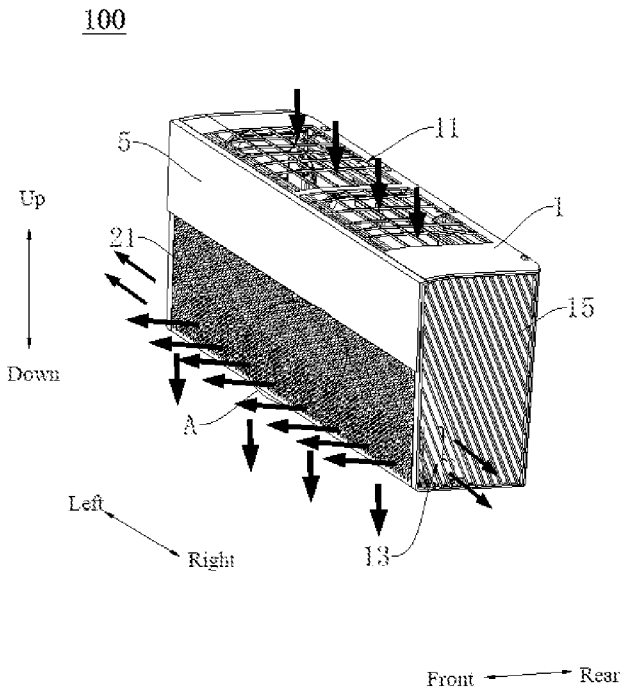
FIG. 1 is a schematic diagram of an air conditioner indoor unit according to some embodiments of the present disclosure, a breezeless member being located at a second position.

REFERENCE NUMBERS air conditioner indoor unit 100;

air dispersing hole 10;

surface frame 1; air inlet 11; first air outlet 12; second air outlet 13; air outlet channel 14; guide portion 141; flow guide portion 142; end plate 15;

breezeless member 2; first panel 21; non-air output portion 211; decorative hole 2111; air output portion 212; first sub air output portion 2121; second sub air output portion 2122; air dispersing module 22; mounting plate 221; first vent hole 2212; guide vane assembly 222; stationary blade 2221; moving blade 2222; limit plate 223; second vent hole 2231;

heat exchanger 3;

fan 4;

second panel 5; accommodating cavity 51;

inner air guide plate 6; first sub inner air guide plate 61; second sub inner air guide plate 62;

driving mechanism 7; motor 71; gear 72; rack 73; second guide rail 731; guide groove 7311; tooth holder 732; tooth portion 7321; non-tooth portion 7322;

chassis 8; motor mounting base 81; first guide rail 82; guide protrusion 821; matching cavity 822;

louver 9.

DESCRIPTION OF EMBODIMENTS

The embodiments of the present disclosure are described below in detail, examples of which are illustrated in the accompanying drawings, and the same or similar reference signs refer to the same or similar elements or elements having the same or similar functions throughout. The embodiments described below with reference to the accompanying drawings are exemplary and are only used to explain the present disclosure, but should not be construed as a limitation on the present disclosure.

An air conditioner indoor unit 100 according to an embodiment of the present disclosure will be described below with reference to the accompanying drawings.

Figure 2:
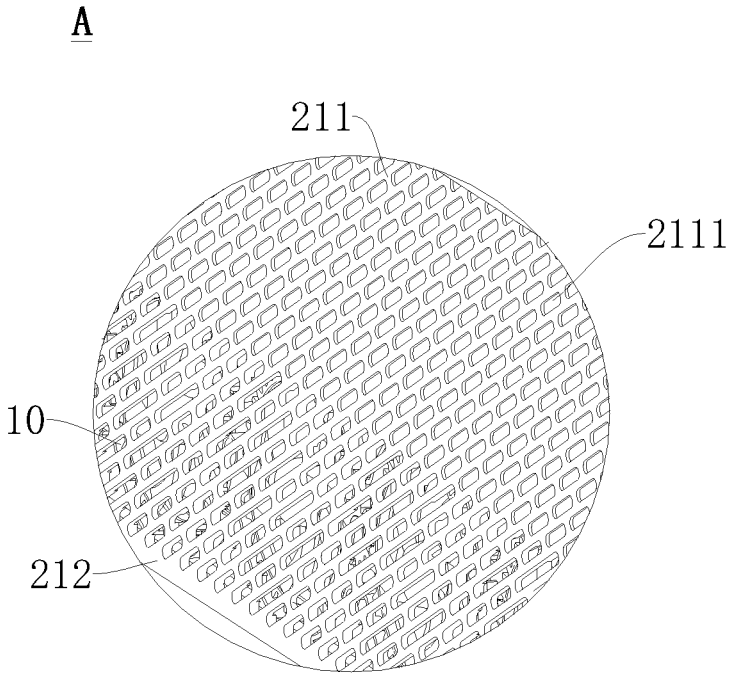
FIG. 2 is an enlarged view at location A in FIG. 1.
Figure 3:
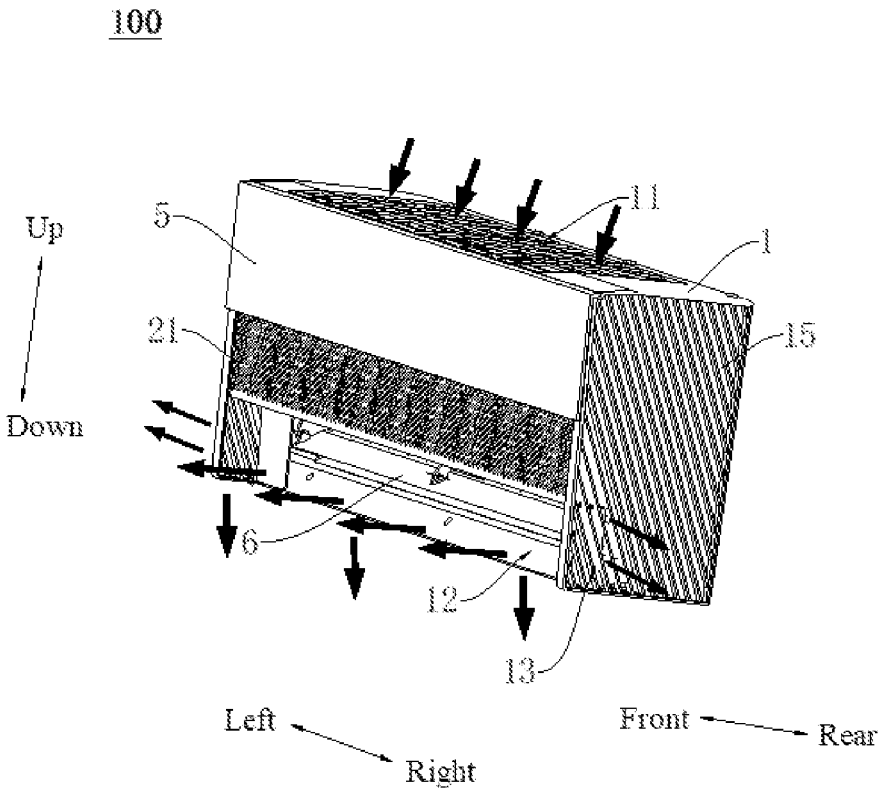
FIG. 3 is a schematic diagram of an air conditioner indoor unit according to some embodiments of the present disclosure, a breezeless member being located at a first position.

Referring to FIGS. 1 to 3, according to an embodiment of the present disclosure in a first aspect, an air conditioner indoor unit 100 includes a surface frame 1, a breezeless member 2, a heat exchanger 3 and a fan 4. An air inlet 11 is formed on the surface frame 1, and a first air outlet 12 is formed in a front lower part of the surface frame 1. The first air outlet 12 penetrates forward through a front part of the surface frame 1 and the first air outlet 12 penetrates downward through a bottom part of the surface frame 1. The first air outlet 12 can be located in a middle part of a length direction (for example, the length direction is a left and right direction) of the surface frame 1, and two ends of a length direction of the first air outlet 12 can extend to two ends of the length direction of the surface frame 1. In this way, the air outlet area and the air output volume of the first air outlet 12 can be increased, so that the air conditioner indoor unit 100 can discharge air forward through the first air outlet 12, and the air conditioner indoor unit 100 can also discharge air downward through the first air outlet 12. A second air outlet 13 is formed on at least one of a left side of the surface frame 1 and a right side of the surface frame 1, so that the air conditioner indoor unit 100 can discharge air from a side through the second air outlet 13. The breezeless member 2 is disposed on a front side of the surface frame 1 and movable between a first position and a second position. For example, the breezeless member 2 is disposed on the front side of the surface frame 1 and movable up and down between the first position and the second position. The breezeless member 2 includes a first panel 21. The heat exchanger 3 and the fan 4 are disposed in the surface frame 1. The heat exchanger 3 can exchange heat with airflow in the surface frame 1, and the fan 4 can drive the airflow to flow.

When the breezeless member 2 is at the first position or the second position, the air is discharged from both the first air outlet 12 and the second air outlet 13, which can form a 3D or 4D air output, so that more angles of air output and larger range of air output can be realized, the air output volume can be increased and the working efficiency of the air conditioner indoor unit 100 can be improved. For example, the second air outlet 13 is formed on the left side of the surface frame 1, and when the air conditioner indoor unit 100 discharges air, the air can be discharged forward, downward and leftward to form the 3D air output. The second air outlet 13 is formed on the right side of the surface frame 1, and when the air conditioner indoor unit 100 discharges air, the air can be discharged forward, downward and rightward to form the 3D air output. The second air outlet 13 is formed on each of the left side of the surface frame 1 and the right side of the surface frame 1, and when the air conditioner indoor unit 100 discharges air, the air can be discharged forward, downward, leftward and rightward to form the 4D air output.

Optionally, the left side and right side of the surface frame 1 each is provided with an end plate 15, the end plate 15 can be in a shape of a grid, and the second air outlet 13 can discharge air from gaps of the end plate 15, so that when the air conditioner indoor unit 100 is in a breezeless mode, the air can be discharged more softly leftward and rightward, and the overall breezeless effect of the air conditioner indoor unit 100 can be improved.

When the air conditioner indoor unit 100 is working, the fan 4 drives the airflow from the outside to enter the air conditioner indoor unit 100 through the air inlet 11. The airflow can be discharged from the first air outlet 12 after heat exchange with the heat exchanger 3, and the airflow after the heat exchange can also be discharged from the second air outlet 13. The first air outlet 12 and the second air outlet 13 are provided, the first air outlet 12 is located at a front part of the surface frame 1 and the first air outlet 12 penetrates the bottom part of the surface frame 1, and the second air outlet 13 is located at a side of the surface frame 1, so that the air conditioner indoor unit 100 can discharge air forward, downward and sideward. In this way, the air conditioner indoor unit 100 can discharge air from multiple angles, and at the same time, the air output volume of the air conditioner indoor unit 100 is increased.

When the breezeless member 2 is located at the first position, the first panel 21 opens the first air outlet 12, the breezeless member 2 does not interfere with the discharge of the air from the first air outlet 12, and the air conditioner indoor unit 100 has a relatively large air output volume. When the breezeless member 2 is located at the second position, the first panel 21 closes the first air outlet 12, and the air conditioner indoor unit 100 can discharge air through the second air outlet 13, which can prevent the cold air from directly blowing the human body when the air conditioner indoor unit 100 is in a cooling mode and thus improve user comfort.

In the air conditioner indoor unit 100 of the present disclosure, when the breezeless member 2 is located at the second position, the breezeless member 2 can soften the air discharged from the first air outlet 12. Even if the first panel 21 blocks the air output from the first air outlet 12 and the air output volume of the first air outlet 12 is reduced, the air conditioner indoor unit 100 can discharge air through the second air outlet 13 at the same time, so that the total air output volume of the air discharged from the air conditioner indoor unit 100 through the first air outlet 12 and the second air outlet 13 is relatively large. In this way, the air output from the air conditioner indoor unit 100 does not directly blow the human body, and the total air output volume of the air conditioner indoor unit 100 is relatively large, so that the indoor temperature can be quickly adjusted, and the user experience is improved.

In the air conditioner indoor unit 100 according to the present disclosure, the surface frame 1 has the first air outlet 12 formed in the front part thereof and the first air outlet 12 penetrates through the bottom part of the surface frame 1, and the surface frame 1 has the second air outlet 13 formed in at least one of the left side and the right side thereof, which can achieve multi-angle air output, increase the air output volume and the air output range, achieve rapid cooling and heating, and improve the working efficiency of the air conditioner indoor unit 100.

Referring to FIGS. 1 to 3, according to some embodiments of the present disclosure, the breezeless member 2 is disposed on the front side of the surface frame 1 and movable up and down between the first position and the second position. This design facilitates the movement of the breezeless member 2. When the breezeless member 2 is located at the first position, the first panel 21 opens the first air outlet 12. When the breezeless member 2 is located at the second position, the first panel 21 closes the first air outlet 12.

Referring to FIGS. 1 to 3, according to some embodiments of the present disclosure, when the breezeless member 2 is located at the second position, the first panel 21 has an air dispersing structure formed in a part thereof opposite to the first air outlet 12. The air dispersing structure may be a plurality of air dispersing holes 10. The airflow can pass through the air dispersing hole 10. The air dispersing hole 10 has a function of dispersing the airflow, so that the air output from the first air outlet 12 is soft and breezeless air output is realized. The air dispersing structure can also be a dispersing grid. The airflow is dispersed when passing through the dispersing grid, which also softens the air output from the first air outlet 12 and realizes the breezeless air output. The breezeless member 2 with the air dispersing structure is provided, so that it is possible to prevent the cold air from blowing directly to the human body. In this way, the air output is softened, and the breezeless air output mode can be realized, and the air conditioner indoor unit 100 can have a relatively large cooling capacity in the breezeless mode.

In the description of the present disclosure, "plurality" means two or more.

Figure 4:
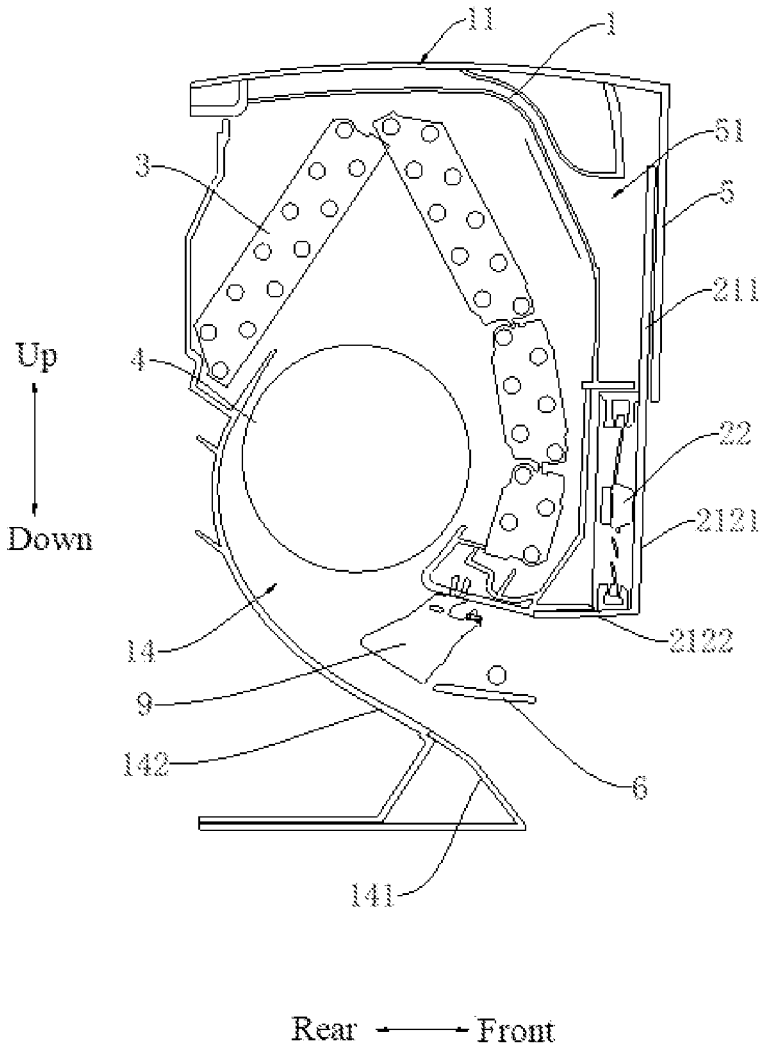
FIG. 4 is a schematic diagram of an internal structure of an air conditioner indoor unit according to some embodiments of the present disclosure, the air conditioner indoor unit being in a cooling mode.
Figure 5:
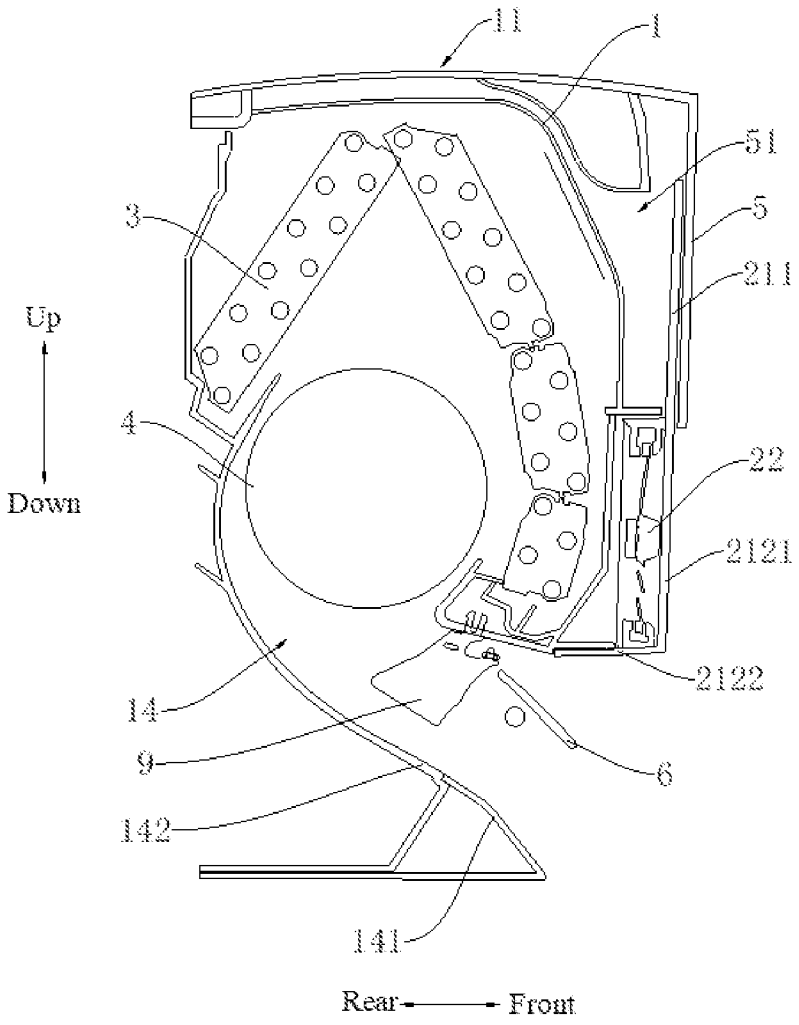
FIG. 5 is a schematic diagram of an internal structure of an air conditioner indoor unit according to some embodiments of the present disclosure, the air conditioner indoor unit being in a heating mode.
Figure 6:
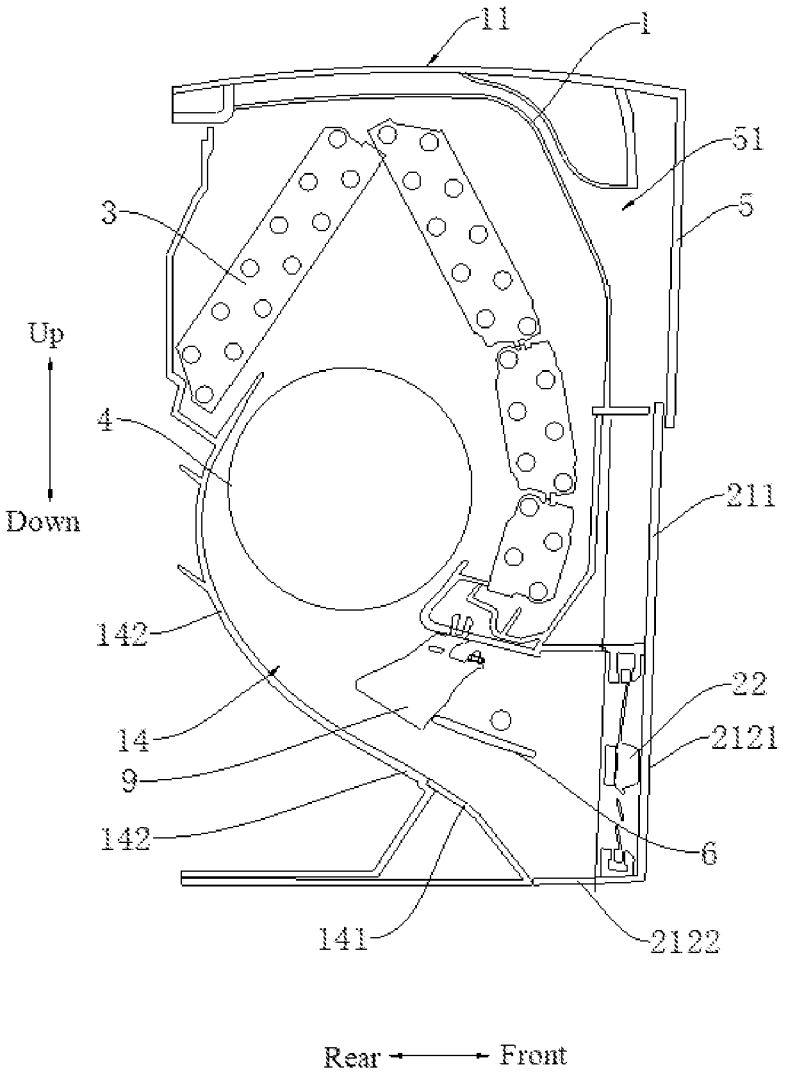
FIG. 6 is a schematic diagram of an internal structure of an air conditioner indoor unit according to some embodiments of the present disclosure, a breezeless member being located at a second position.

Referring to FIGS. 4 to 6, according to some embodiments of the present disclosure, the surface frame 1 has a second panel 5 provided at an upper end thereof and the second panel 5 is located on the front side of the surface frame 1. An accommodating cavity 51 is defined between the second panel 5 and the surface frame 1, and a bottom part of the accommodating cavity 51 can be open. When the breezeless member 2 is located at the second position, at least a part of the first panel 21 is located in the accommodating cavity 51. For example, when the breezeless member 2 is located at the second position, a part of the first panel 21 is located in the accommodating cavity 51; or when the breezeless member 2 is located at the second position, the entire first panel 21 is located in the accommodating cavity 51. This design allows the second panel 5 to protect the first panel 21. At the same time, the second panel 5 can limit and guide the movement of the first panel 21, which facilitates the movement of the breezeless member 2 in a predetermined direction between the first position and the second position.

Figure 8:
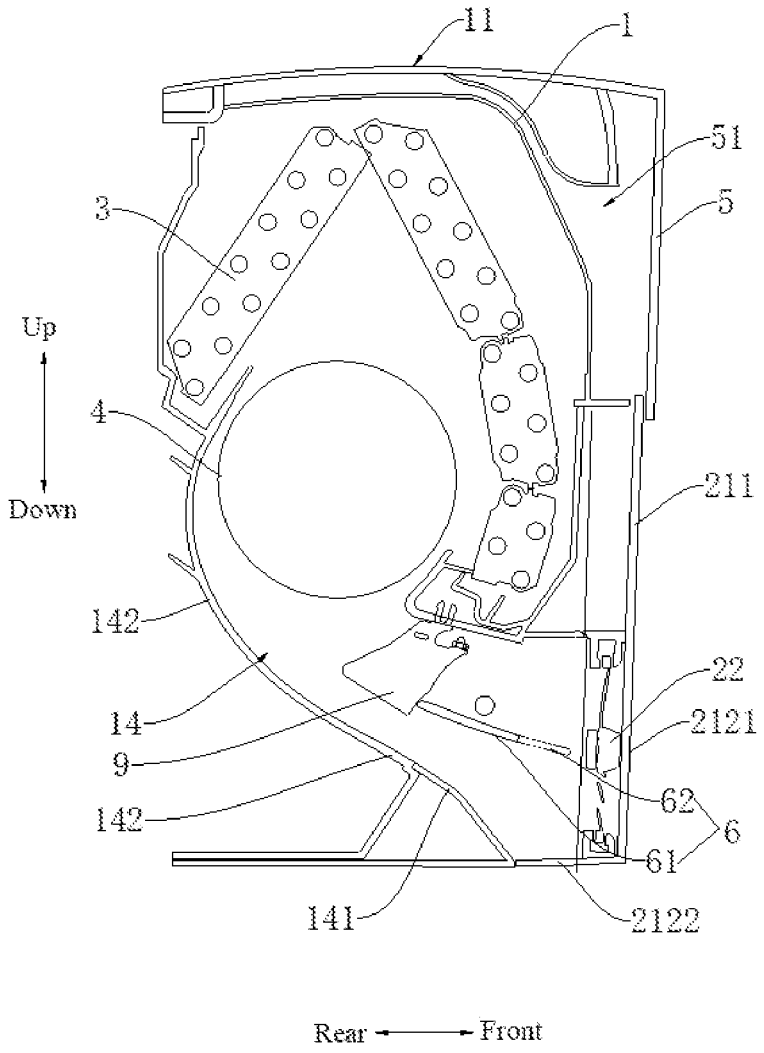
FIG. 8 is a schematic diagram of an internal structure of an air conditioner indoor unit according to other embodiments of the present disclosure, a breezeless member being located at a second position.
Figure 9:
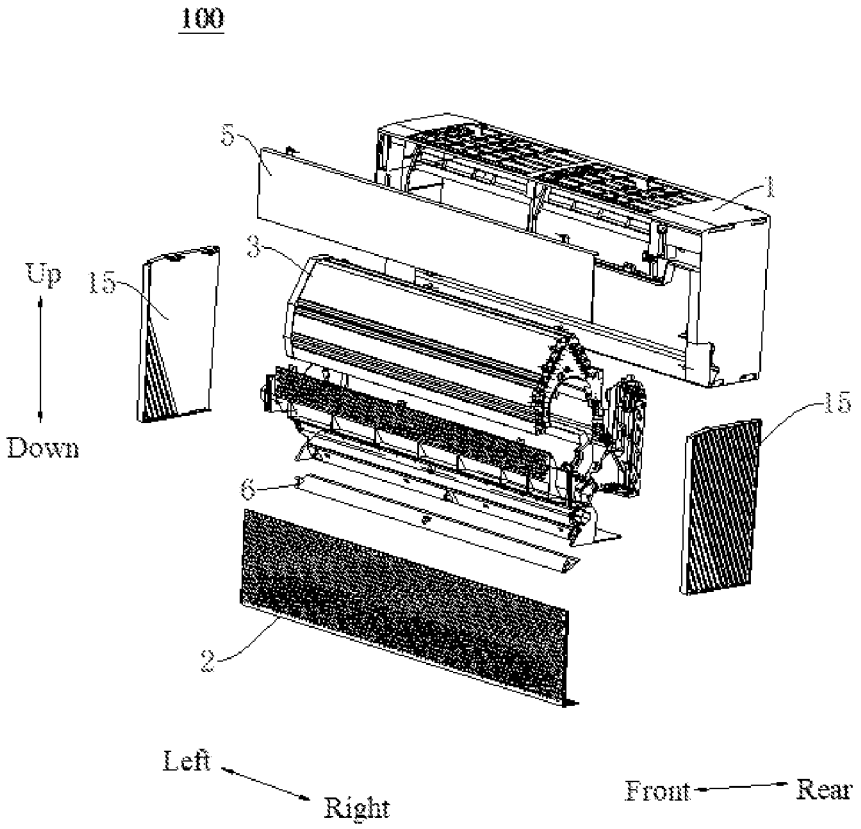
FIG. 9 is an exploded view of an air conditioner indoor unit according to some embodiments of the present disclosure.
Figure 10:
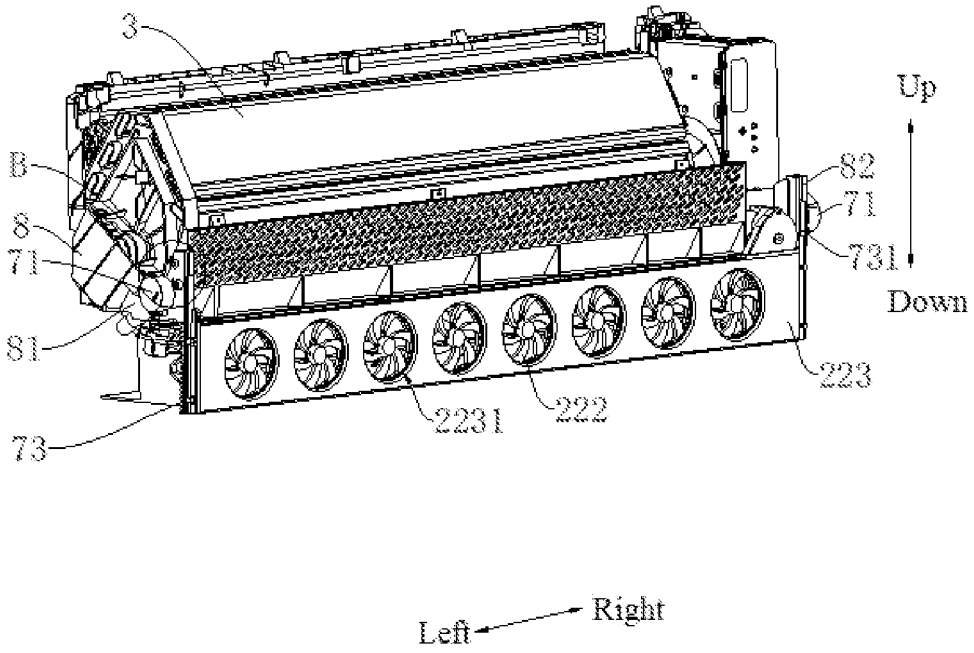
FIG. 10 is a schematic diagram of a partial structure of an air conditioner indoor unit according to some embodiments of the present disclosure.
Figure 11:
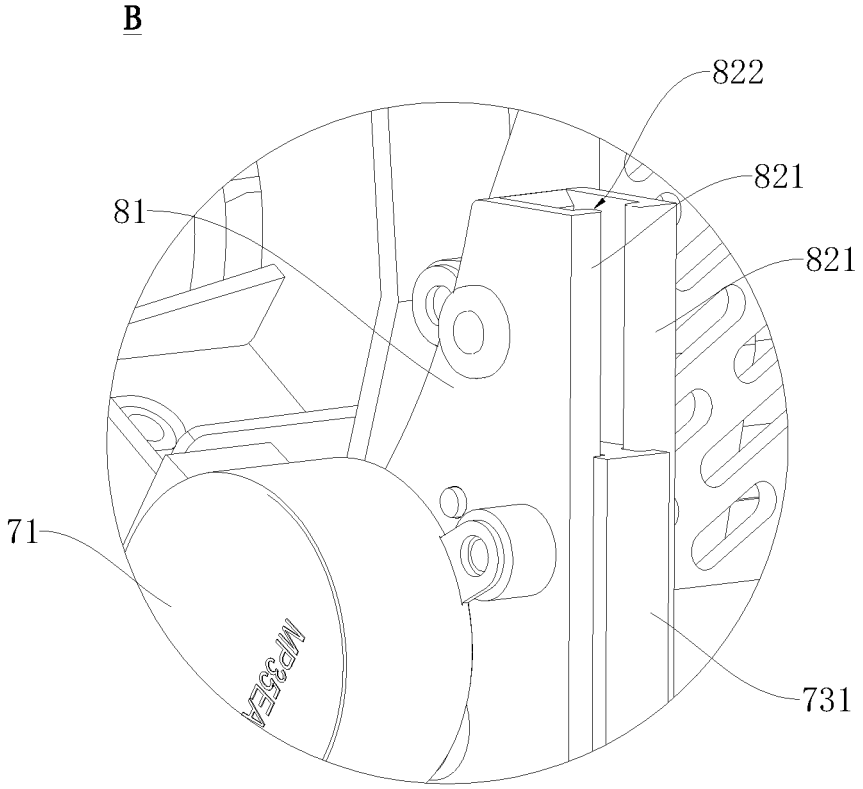
FIG. 11 is an enlarged view at location B in FIG. 10.
Figure 12:
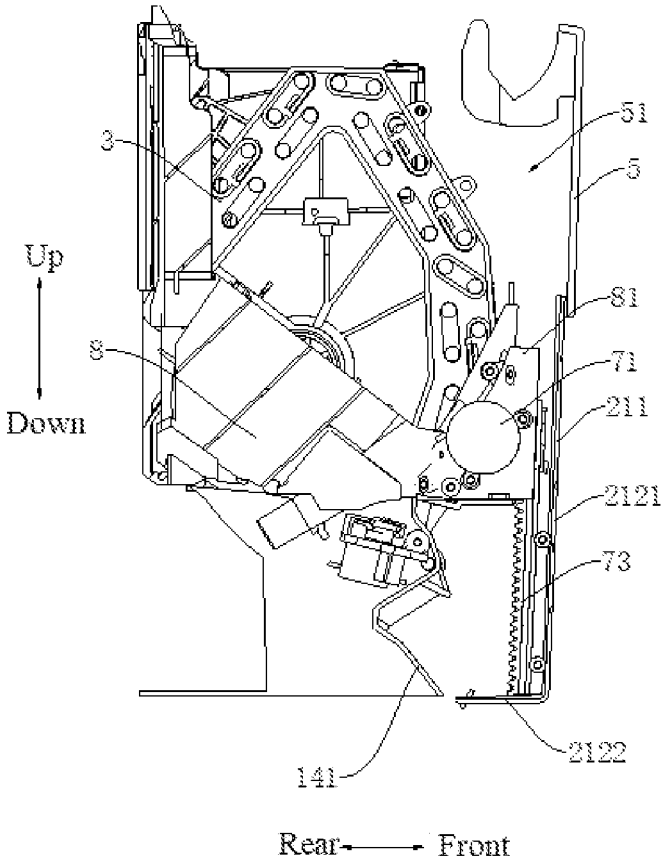
FIG. 12 is a side view of a partial structure of an air conditioner indoor unit according to some embodiments of the present disclosure.
Figure 13:
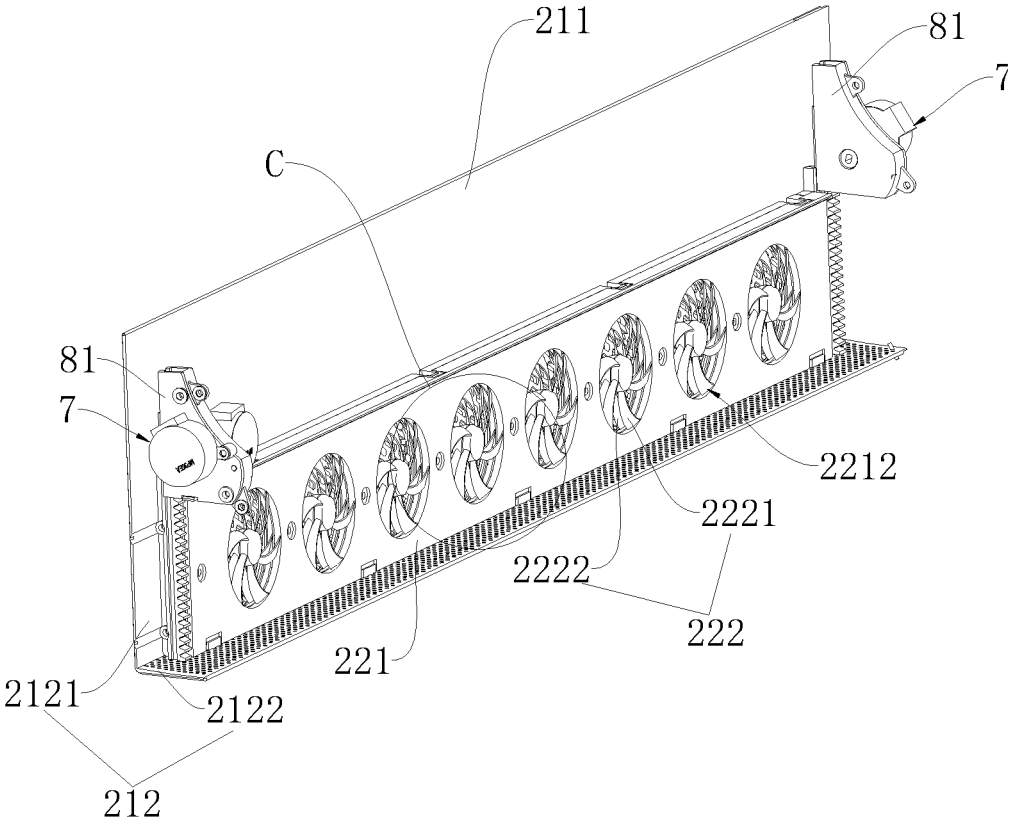
FIG. 13 is a structural diagram of a breezeless member and a driving mechanism according to some embodiments of the present disclosure.
Figure 14:
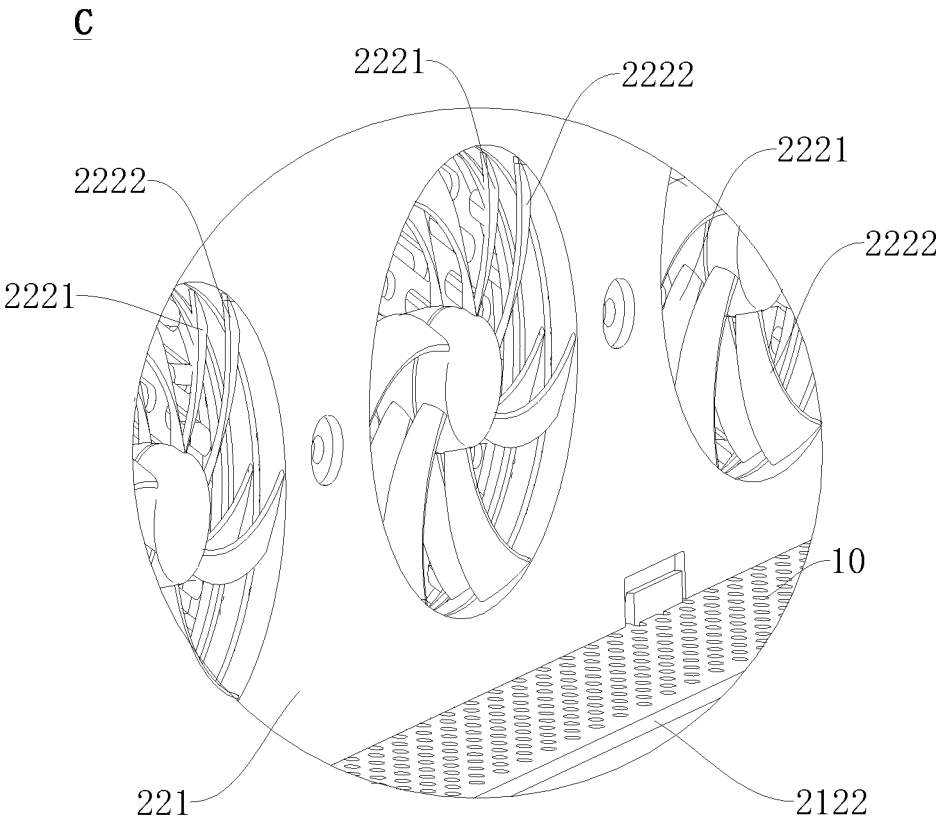
FIG. 14 is an enlarged view at location C in FIG. 13.
Figure 15:
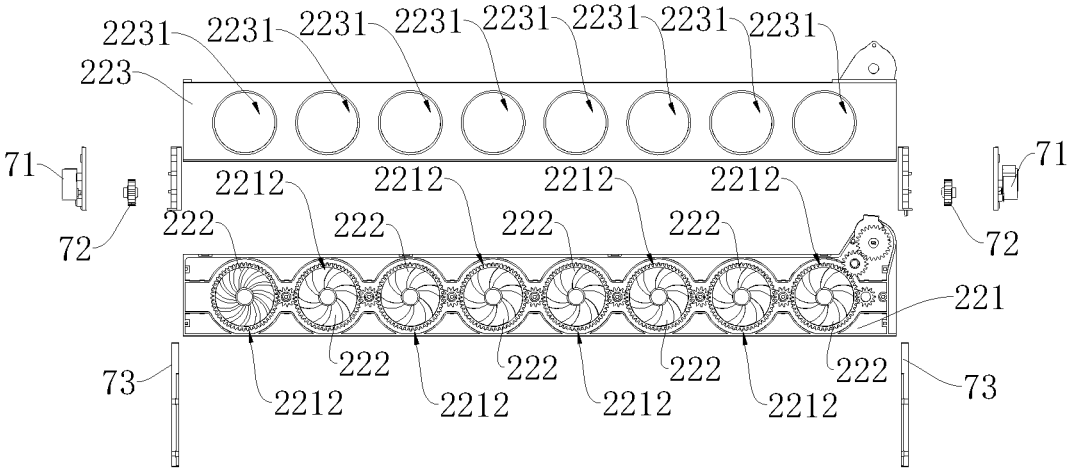
FIG. 15 is an exploded view of a breezeless member and a driving mechanism according to some embodiments of the present disclosure.

Referring to FIGS. 6 and 8, optionally, the first panel 21 includes an air output portion 212 having an air dispersing structure thereon. When the breezeless member 2 is located at the second position, the air output portion 212 and the first air outlet 12 are opposite to each other, so that the air output from the first air outlet 12 can be dispersed by the air dispersing structure, thereby realizing the breezeless air output from the first air outlet 12.

Referring to FIGS. 6 and 8, further, the first panel 21 includes a non-air output portion 211 and the air output portion 212 that are connected to each other up and down. The air output portion 212 has a plurality of air dispersing structures formed thereon, and the airflow can be dispersed when passing through the air dispersing structure to reduce the breeziness of the airflow. The non-air output portion 211 is located above the air output portion 212. When the breezeless member 2 is located at the second position, the air output portion 212 is opposite to the first air outlet 12, so that the air output from the first air outlet 12 can be dispersed by the air dispersing structure, thereby realizing the breezeless air output from the first air outlet 12. The non-air output portion 211 is located in the accommodating cavity 51, which can prevent the first panel 21 from falling off from the accommodating cavity 51.

Optionally, when the air dispersing structure is a plurality of air dispersing holes 10, the non-air output portion 211 has a plurality of decorative holes 2111 formed therein and having the same appearance as the air dispersing holes 10. This design makes the air output portion 212 and the non-air output portion 211 have the same appearance and is more aesthetic.

Referring to FIGS. 4 to 8, further, the breezeless member 2 includes an air dispersing module 22 having an air dispersing function. The air dispersing module 22 is disposed on the air output portion 212 and is located at an inner side of the air output portion 212, and the air output portion 212 can protect the air dispersing module 22.

Further, the air dispersing module 22 includes a mounting plate 221. The mounting plate 221 has a plurality of first vent holes 2212 formed therein and arranged in a left and right direction. The mounting plate 221 is connected to the first panel 21, and the airflow can pass through the first vent hole 2212, so as to ensure that when the breezeless member 2 is located at the second position, the air output from the air conditioner indoor unit 100 can flow through the first vent hole 2212 and be smoothly discharged from the first air outlet 12.

Further, the air dispersing module 22 includes an air dispersing mechanism with an air dispersing function. The air dispersing mechanism is disposed at the first vent hole 2212. The air dispersing mechanism can further disperse the airflow flowing through the first vent hole 2212, so that the airflow is softer.

Further, the air dispersing mechanism includes a guide vane assembly 222. Each first vent hole 2212 is provided with a guide vane assembly 222. The guide vane assembly 222 includes a stationary blade 2221 and a rotatable moving blade 2222. The stationary blade 2221 and the moving blade 2222 are arranged along an axial direction of the first vent hole 2212. When the airflow passes through the first vent hole 2212, the relative position of blades of the moving blade 2222 and blades of the stationary blade 2221 can be adjusted by controlling the rotation of the moving blade 2222. In this way, the vent area of the first vent hole 2212 can be adjusted, and the air output volume and air output speed can be adjusted. When the air conditioner indoor unit 100 is working and the breezeless member 2 is located at the second position, the moving blade 2222 can be controlled to rotate to a certain angle and then stop rotating, or the moving blade 2222 can be controlled to rotate all the time.

Referring to FIGS. 9 to 15, optionally, the moving blade 2222 is disposed on a front side or a rear side of the stationary blade 2221. When the moving blade 2222 is disposed on the front side of the stationary blade 2221, the airflow first passes through the motionless stationary blade 2221, and then passes through the rotatable moving blade 2222. The airflow is subject to the guiding, rectifying and dispersing effects of the stationary blade 2221 in turn, and then flows through the moving blade 2222. The moving blade 2222 can rotate in a certain direction, so that the airflow has a certain rotating component after passing through the moving blade 2222. Finally, the airflow passes through the air dispersing structure on the air output portion 212 and is further dispersed, so that the air output is softer and more resembles the natural wind.

When the moving blade 2222 is disposed on the rear side of the stationary blade 2221, the airflow passes through the moving blade 2222 and the stationary blade 2221 in turn when flowing through the air dispersing module 22. The moving blade 2222 can have a certain rotation direction, so that the airflow has a certain rotational component after flowing through the moving blade 2222. Then the airflow is guided, rectified and dispersed by the stationary blades 2221, and finally the airflow is further dispersed through the air dispersing structure on the air output portion 212, making the air output softer and more resemble the natural wind.

Referring to FIGS. 9 to 15, optionally, the moving blade 2222 and the stationary blade 2221 are disposed coaxially. This design makes it easy to adjust the vent area of the first vent hole 2212 by rotating the moving blade 2222, and at the same time facilitates disposing of the moving blade 2222 and the stationary blade 2221.

Referring to FIGS. 9 to 15, according to some optional embodiments of the present disclosure, the air dispersing module 22 includes a limit plate 223. The limit plate 223 is connected to the first panel 21, and the limit plate 223 is disposed on a front side of the mounting plate 221 and connected to the mounting plate 221. The limiting plate 223 has second vent holes 2231 formed therein and opposite to and in communication with the first vent holes 2212, so that the air output flowing through the first vent holes 2212 can be discharged from the second vent holes 2231, and the limit plate 223 is prevented from blocking the airflow. An accommodating cavity adapted to accommodate the air dispersing mechanism is defined between the mounting plate 221 and the limit plate 223. The mounting plate 221 and the limit plate 223 can protect the air dispersing mechanism. The air output from the first air outlet 12 can enter the accommodating cavity through the first vent hole 2212, the air dispersing mechanism in the accommodating cavity can change the flowing direction of the airflow, and then the air is discharged from the second vent hole 2231.

Referring to FIGS. 4 to 8, according to some embodiments of the present disclosure, the air output portion 212 includes a first sub air output portion 2121 and a second sub air output portion 2122 that are connected to each other up and down. Each of the first sub air output portion 2121 and the second sub air output portion 2121 has the air dispersing structure formed thereon, so that the airflow can be dispersed by the air dispersing structure when passing through the first sub air output portion 2121, and the airflow can be dispersed by the air dispersing structure when passing through the second sub air output portion 2122, thereby making the airflow softer. An included angle is defined between the first sub air output portion 2121 and the second sub air output portion 2122. The air dispersing module 22 is disposed on the first sub air output portion 2121, and the air dispersing module 22 can soften the airflow flowing through the first sub air output portion 2121 and adjust the flowing direction of the airflow. When the breezeless member 2 is located at the second position, the first sub air output portion 2121 is located at a front side of the first air outlet 12, and the second sub air output portion 2122 is located at a bottom part of the first air outlet 12. This design enables, when the airflow in the air conditioner indoor unit 100 is discharged through the first air outlet 12, the airflow passing through the first sub air output portion 2121 to be output forward and the airflow passing through the second sub air output portion 2122 to be discharged generally downward, which is beneficial to realizing the multi-angle air output of the air conditioner indoor unit 100.

Referring to FIGS. 4 to 6, according to some optional embodiments of the present disclosure, the air output portion 212 includes a first sub air output portion 2121 and a second sub air output portion 2122 that are connected to each other up and down. Each of the first sub air output portion 2121 and the second air output portion 2122 has the air dispersing structure formed thereon, so that the airflow can be dispersed by the air dispersing structure when passing through the first sub air output portion 2121, and the airflow can be dispersed by the air dispersing structure when passing through the second sub air output portion 2122, thereby making the airflow softer. There is an included angle between the first sub air outlet portion 2121 and the second sub air outlet portion 2122. When the breezeless member 2 is at the second position, the first sub air outlet portion 2121 is located at the front side of the first air outlet 12, and the second sub air outlet portion 2122 is located at the bottom of the first air outlet 12. This design enables, when the airflow in the air conditioner indoor unit 100 is discharged through the first air outlet 12, the airflow passing through the first sub air output portion 2121 to be output forward and the airflow passing through the second sub air output portion 2122 to be discharged generally downward, which is beneficial to realizing the multi-angle air output of the air conditioner indoor unit 100.

Referring to FIGS. 4 to 6, further, the included angle between the first sub air output portion 2121 and the second sub air output portion 2122 ranges from 60° to 120°. If the included angle between the first sub air output portion 2121 and the second sub air output portion 2122 is too large, the structure of the air conditioner indoor unit 100 will not be compact, and the appearance of the whole unit will be less aesthetic. If the included angle between the first sub air output portion 2121 and the second sub air output portion 2122 is too small, it is easy to cause unsmooth flowing when the airflow passing through the second sub air output portion 2122 and relatively large noise because of the unsmooth flowing of the airflow. By limiting the included angle between the first sub air output portion 2121 and the second sub air output portion 2122 within an appropriate range, the air conditioner indoor unit 100 can be compact while it is ensured that the airflow can smoothly pass through the second sub air output portion 2122 and be discharged downward.

Referring to FIGS. 4 to 6, according to some embodiments of the present disclosure, the surface frame 1 has an air outlet channel 14 in communication with the first air outlet 12 and the second air outlet 13. The airflow in the air outlet channel 14 can be discharged through the first air outlet 12. The airflow in the air outlet channel 14 can also be discharged through the second air outlet 13. A guide portion 141 is formed on a part of a bottom wall of the air outlet channel 14 adjacent to the first air outlet 12. The guide portion 141 is used to guide the airflow toward the first air outlet 12. The guide portion 141 may direct a part of the airflow downward. The guide portion 141 also may direct a part of the airflow forward.

Referring to FIGS. 4 to 6, further, in a rear-to-front direction, the guide portion 141 extends obliquely and downward to guide a part of the airflow to a bottom part of the first air outlet 12. This design enables the guide portion 141 to guide the airflow to be discharged from the bottom part of the air conditioner indoor unit 100, which is beneficial to increasing the air output volume from the bottom part of the air conditioner indoor unit 100, and realizing the multi-angle air output of the air conditioner indoor unit 100.

Optionally, the air outlet channel 14 has a louver 9 provided therein, and the louver 9 can adjust the flowing direction of the airflow in the air outlet channel.

Referring to FIGS. 4 to 8, according to some optional embodiments of the present disclosure, an included angle between the guide portion 141 and a vertical direction ranges from 15° to 60°. If the included angle between the guide portion 141 and the vertical direction is too small, then when the airflow in the air outlet channel 14 flows to the guide portion 141 along a bottom wall of the air outlet channel 14, the flowing direction of the airflow changes greatly, and the guiding effect of the guide portion 141 on the airflow is reduced. If the included angle between the guide portion 141 and the vertical direction is too large, it is unfavorable for the guide portion 141 to guide the airflow to the bottom part of the first air outlet 12, and the air output volume from the bottom part of the air conditioner indoor unit 100 decreases. By limiting the included angle between the guide portion 141 and the vertical direction within an appropriate range, it is convenient for the guide portion 141 to guide a part of the airflow in the air outlet channel 14 to be discharged from the bottom part of the first air outlet 12.

Referring to FIGS. 4 to 6, according to some optional embodiments of the present disclosure, the bottom wall of the air outlet channel 14 has a part thereof on a side of the guide portion 141 away from the first air outlet 12 as a flow guide portion 142, and the included angle between the guide portion 141 and the vertical direction is smaller than an included angle between the flow guide portion 142 and the vertical direction. This design enables the flow guide portion 142 to effectively guide the airflow in the air outlet channel 14 to flow. When the airflow flows from the flow guide portion 142 to the guide portion 141, the flowing direction of the airflow changes abruptly, and the guide portion 141 can effectively guide a part of the airflow to be discharged from the bottom part of the first air outlet 12.

Referring to FIG. 6, optionally, when the breezeless member 2 is located at the second position, the guide portion 141 is opposite to or abuts against a bottom part of the first panel 21 in a front and rear direction. This design can prevent the airflow in the air outlet channel 14 from leaking from the gap between the guide portion 141 and the bottom part of the first panel 21, and avoid problems, such as noise and condensation due to air leakage.

Referring to FIGS. 4 to 6, according to some embodiments of the present disclosure, the surface frame 1 has an air outlet channel 14 therein that is in communication with both the first air outlet 12 and the second air outlet 13, and the air outlet channel 14 has a rotatable inner air guide plate 6 provided therein. The inner air guide plate 6 is disposed in the air outlet channel 14, so that change and adjustment of the air outlet direction can be realized by the rotation of the inner air guide plate 6.

Referring to FIGS. 4 to 6, optionally, the air conditioner indoor unit 100 has a heating mode and a cooling mode. When the breezeless member 2 is located at the first position and the air conditioner indoor unit 100 is in the cooling mode, an included angle between the inner air guide plate 6 and a horizontal plane ranges from 0 to 45°, so that the inner air guide plate 6 can guide the airflow in the air outlet channel 14 to flow forward from the first air outlet 12. In this way, the cold air can reach a higher position in the room, which is conducive to the uniform cooling of the room. When the breezeless member 2 is located at the first position and the air conditioner indoor unit 100 is in the heating mode, the included angle between the inner air guide plate 6 and the horizontal plane ranges from 45° to 90°, so that the inner air guide plate 6 can guide the airflow in the air outlet channel 14 to flow downward from the first air outlet 12. In this way, the warm air can reach a lower position in the room, which is beneficial to the uniform heating of the room.

Referring to FIGS. 4 to 6, optionally, a length of the inner air guide plate 6 in an air outlet direction of the first air outlet 12 is adjustable. This design can adjust the guiding effect of the inner air guide plate 6 on the airflow. When the inner air guide plate 6 is long, the guiding effect of the inner air guide plate 6 on the airflow is strong. Referring to FIGS. 4 to 6, according to some optional embodiments of the present disclosure, when the breezeless member 2 is located at the first position, the length of the inner air guide plate 6 in the air outlet direction of the first air outlet 12 is L1. When the breezeless member 2 is located at the second position, the length of the inner air guide plate 6 in the air outlet direction of the first air outlet 12 is L2, and L2 is smaller than L1. This design enables the inner air guide plate 6 to have a strong guiding effect on the airflow when the breezeless member 2 is located at the first position, which is beneficial to increasing the air output volume of the first air outlet 12; and when the breezeless member 2 is located at the second position, by reducing the length of the inner air guide plate 6 in the air outlet direction of the first air outlet 12, the inner air guide plate 6 can be prevented from interfering with the breezeless member 2.

Figure 7:
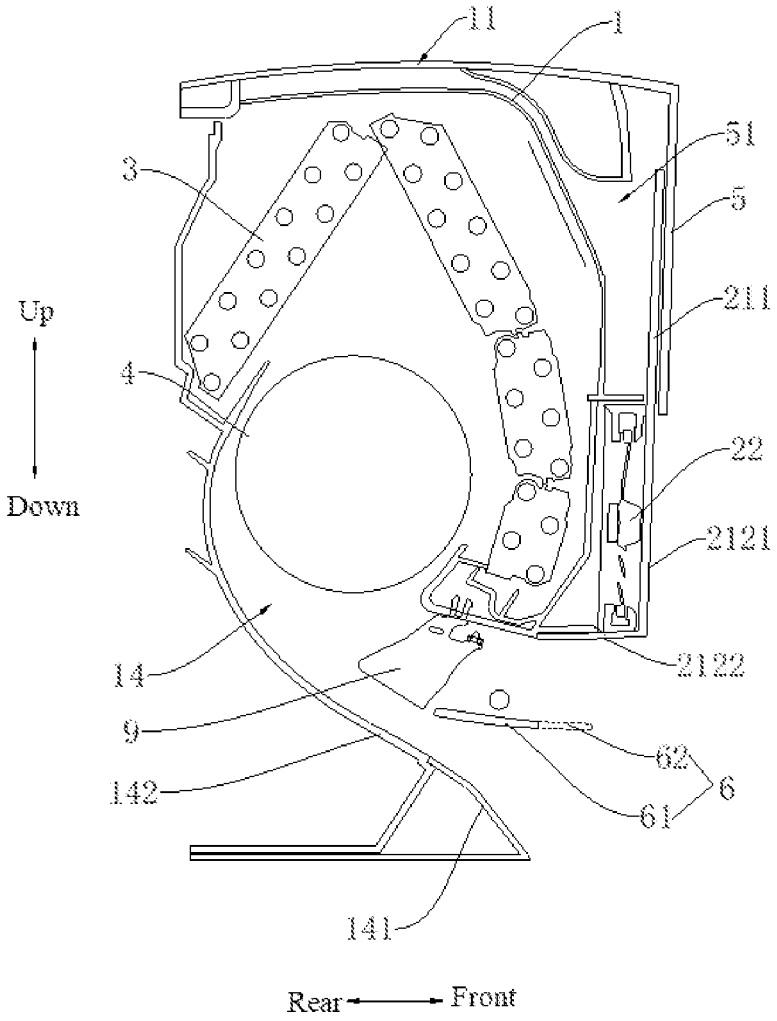
FIG. 7 is a schematic diagram of an internal structure of an air conditioner indoor unit according to other embodiments of the present disclosure, a breezeless member being located at a first position.

Referring to FIGS. 7 and 8, according to some optional embodiments of the present disclosure, the inner air guide plate 6 includes a first sub inner air guide plate 61 and a second sub inner air guide plate 62. The first sub inner air guide plate 61 is rotatably connected to an inner wall of the air outlet channel 14, and this design facilitates the adjustment of the included angle between the inner air guide plate 6 and the horizontal plane. The second sub inner air guide plate 62 is movably disposed on the first sub inner air guide plate 61 to adjust the length of the inner air guide plate 6 in the air outlet direction of the first air outlet 12. This design facilitates the adjustment of the length of the inner air guide plate 6 in the air outlet direction of the first air outlet 12, and the structure is simple. For example, the adjustment of the length of the inner air guide plate 6 in the air outlet direction of the first air outlet 12 can be realized by the movement of the second sub air guide plate relative to the first sub air guide plate.

Referring to FIG. 7 and FIG. 8, further, the second sub inner air guide plate 62 is slidable or rotatable relative to the first sub inner air guide plate 61. When the second sub inner air guide plate 62 is slidable relative to the first sub inner air guide plate 61, the second sub inner air guide plate 62 can be slid onto the first sub inner air guide plate 61 to make the second sub inner air guide plate 62 overlap the first sub inner air guide plate 61, thereby reducing the length of the inner air guide plate 6 in the air outlet direction of the first air outlet 12. It is also possible to slide the second sub inner air guide plate 62 to make the second sub inner air guide plate 62 become an extension of the first sub inner air guide plate 61, thereby increasing the length of the inner air guide plate 6 in the air outlet direction of the first air outlet 12. When the second sub inner air guide plate 62 is rotatable relative to the first sub inner air guide plate 61, the second sub inner air guide plate 62 can be rotated to make the second sub inner air guide plate 62 overlap the first sub inner air guide plate 61, thereby reducing the length of the inner air guide plate 6 in the air outlet direction of the first air outlet 12. It is also possible to rotate the second sub inner air guide plate 62 to make the second sub inner air guide plate 62 become an extension of the first sub inner air guide plate 61, thereby further increasing the length of the inner air guide plate 6 in the air outlet direction of the first air outlet 12.

Referring to FIG. 7 and FIG. 8, further, a sliding cavity is defined in the first sub inner air guide plate 61, and the second sub inner air guide plate 62 is slidably disposed in the sliding cavity. This design makes the sliding process of the second sub inner air guide plate 62 more reliable, and the disengagement of the second sub inner air guide plate 62 and the first sub inner air guide plate 61 is avoided.

Referring to FIGS. 6 and 8, according to some embodiments of the present disclosure, the surface frame 1 has an air outlet channel 14 therein that is in communication with both the first air outlet 12 and the second air outlet 13. When the breezeless member 2 is located at the first position, the bottom part of the first panel 21 is adapted to abut against a top wall of the air outlet channel 14. This design prevents the airflow in the air outlet channel 14 from breaking into the gap between the top wall of the air outlet channel 14 and the first panel 21 when the breezeless member 2 is located at the first position, thereby preventing loss of air volume.

Referring to FIGS. 9 to 15, according to some embodiments of the present disclosure, a driving mechanism 7 for driving the breezeless member 2 to move includes a motor 71, a gear 72 and a rack 73. For example, the driving mechanism 7 is used to drive the breezeless member 2 to move up and down, when the breezeless member 2 is disposed on the front side of the surface frame 1 and movable up and down between the first position and the second position. The motor 71 is disposed on a chassis 8 or the surface frame 1 of the air conditioner indoor unit 100. The gear 72 is connected to an output shaft of the motor 71, and the motor 71 can drive the gear 72 to rotate when the motor 71 works. The rack 73 is disposed on the breezeless member 2 and extends in the up and down direction. The rack 73 is adapted to engage with the gear 72. Through the cooperation between the rack 73 and the gear 72, when the motor 71 is working, the rack 73 can be driven to move, and the breezeless member 2 can be driven to move.

Referring to FIGS. 9 to 15, optionally, the rack 73 is disposed on the first panel 21, and the rack 73 is detachably connected to the first panel 21 or the rack 73 is integrally formed with the first panel 21. When the rack 73 is detachably connected to the first panel 21, the driving mechanism 7 and the breezeless member 2 are easily assembled. For example, the rack 73 is connected to the first panel 21 in a clamping manner; or the rack 73 and the first panel 21 are connected in a screwing manner. When the rack 73 and the first panel 21 are integrally formed, the rack 73 and the first panel 21 have high connection strength, which can improve the reliability of the air conditioner indoor unit 100.

In some embodiments of the present disclosure, the breezeless member 2 includes an air dispersing module, the rack 73 is disposed on the air dispersing module, and the rack 73 is detachably connected to the air dispersing module, so that the driving mechanism 7 and the breezeless member 2 are easily assembled. For example, the rack 73 is connected to the air dispersing module in a clamping manner; or the rack 73 and the air dispersing module are connected in a screwing manner.

Referring to FIGS. 9 to 15, optionally, one of the chassis 8 and the breezeless member 2 has a first guide rail 82 provided thereon, and the other of the chassis 8 and the breezeless member 2 has a second guide rail 731 provided thereon. The second guide rail 731 is matched with the first guide rail 82. For example, the chassis 8 has a first guide rail 82 provided thereon, and the breezeless member 2 has a second guide rail 731 provided thereon that is matched with the first guide rail 82. Or, the breezeless member 2 has a first guide rail 82 provided thereon, and the chassis 8 has a second guide rail 731 provided thereon that is matched with the first guide rail 82. Through the cooperation of the first guide rail 82 and the second guide rail 731, the movement of the breezeless member 2 between the first position and the second position can be realized. The first guide rail 82 and the second guide rail 731 can mutually guide each other, which makes the movement of the breezeless member 2 more reliable.

Alternatively, one of the surface frame 1 and the breezeless member 2 has a first guide rail 82 provided thereon, and the other of the surface frame 1 and the breezeless member 2 has a second guide rail 731 provided thereon. The second guide rail 731 is matched with the first guide rail 82. For example, the surface frame 1 has a first guide rail 82 provided thereon, and the breezeless member 2 has a second guide rail 731 provided thereon that is matched with the first guide rail 82. Or, the breezeless member 2 has a first guide rail 82 provided thereon, and the surface frame 1 has a second guide rail 731 provided thereon that is matched with the first guide rail 82. Through the cooperation of the first guide rail 82 and the second guide rail 731, the movement of the breezeless member 2 between the first position and the second position can be realized. The first guide rail 82 and the second guide rail 731 can mutually guide each other, which makes the movement of the breezeless member 2 more reliable.

Referring to FIGS. 9 to 15, further, the chassis 8 or the surface frame 1 has a motor mounting base 81 provided thereon, and the motor 71 is disposed on the motor mounting base 81, so that the motor 71 is stably mounted on the chassis 8. The first guide rail 82 is disposed on the motor mounting base 81, and the second guide rail 731 is disposed on the rack 73. This design makes the first guide rail 82 and the second guide rail 731 easy to form, makes the structure simple, and makes it convenient for the first guide rail 82 and the second guide rail 731 to cooperate.

Referring to FIGS. 9 to 15, further, the motor mounting base 81 has a matching cavity 822 formed therein and having a front side that is open. At least a part of the gear 72 is located in the matching cavity 822. For example, a part of the gear 72 is located in the matching cavity 822; or the entire gear 72 is located in the matching cavity 822. A part of the rack 73 extends into the matching cavity 822 and engages with the gear 72. This design enables the matching cavity 822 to protect the gear 72. The second guide rail 731 includes guide grooves 7311 formed on a left side wall and a right side wall of the rack 73. The first guide rail 82 includes guide protrusions 821 formed on a left side wall and a right side wall of an open end of the matching cavity 822. Each guide protrusion 821 fits in a corresponding guide groove 7311 and is slidable up and down relative to the guide groove 7311. This design makes it difficult for the first guide rail 82 and the second guide rail 731 to disengage, and the guide protrusion 821 moves within the guide groove 7311 smoothly.

Figure 16:
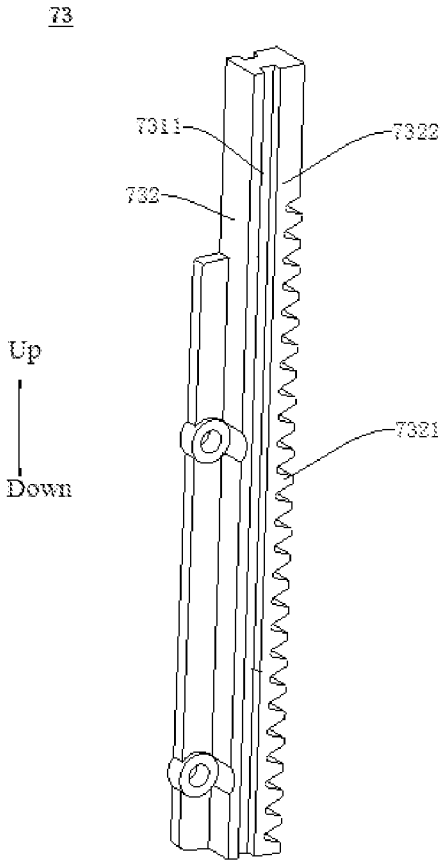
FIG. 16 is a structural diagram of a rack according to some embodiments of the present disclosure.

Referring to FIG. 16, according to some optional embodiments of the present disclosure, the rack 73 includes a tooth holder 732. The tooth holder 732 has a tooth portion 7321 and a non-tooth portion 7322 on a surface thereof facing towards the gear 72. The tooth portion 7321 extends in an up and down direction, and the tooth portion 7321 is adapted to engage with the gear 72. The non-tooth portion 7322 is located on at least one side of a length direction of the tooth portion 7321, and the non-tooth portion 7322 cannot engage with the gear 72. For example, the non-tooth portion 7322 is located above the tooth portion 7321. When the breezeless member 2 moves downward, the tooth portion 7321 engages with the gear 72, so that the rack 73 moves downward relative to the gear 72. With the downward movement of the rack 73, when the gear 72 contacts the non-tooth portion 7322, the non-tooth portion 7322 cannot engage with the gear 72, so that the rack 73 can be prevented from moving downward excessively. Or, the non-tooth portion 7322 is located under the tooth portion 7321. When the breezeless member 2 moves upward, the tooth portion 7321 engages with the gear 72, so that the rack 73 moves upward relative to the gear 72. With the upward movement of the rack 73, when the gear 72 contacts the non-tooth portion 7322, the non-tooth portion 7322 cannot engage with the gear 72, so that the rack 73 can be prevented from moving upward excessively. Or, the non-tooth portion 7322 is located on both sides of the length direction of the tooth portion 7321, and in this case, the non-tooth portion 7322 provided can prevent the rack 73 from moving upward and downward excessively. The non-tooth portion 7322 is provided, which can prevent the rack 73 from moving too much and disengaging from the gear 72, thereby improving the reliability of the driving mechanism 7.

The air conditioner according to the embodiments of the present disclosure in the second aspect includes the air conditioner indoor unit 100 according to the embodiments of the present disclosure in the first aspect. For example, the air conditioner is a split floor-standing air conditioner, and the air conditioner indoor unit 100 is a split floor-standing air conditioner indoor unit 100; or the air conditioner is a split wall-mounted air conditioner, and the air conditioner indoor unit 100 is a split wall-mounted air conditioner indoor unit 100.

According to the air conditioner of the present disclosure, the above air conditioner indoor unit 100 is provided, the air conditioner indoor unit 100 can discharge air from multiple angles and the air output volume is large, so that the air conditioner can discharge air from multiple angles, the air output volume and the air output range of the air conditioner can be improved, and the working efficiency of the air conditioner is improved.

In the description of this specification, the appearance of reference terms "an embodiment," "some embodiments," "exemplary embodiment," "example," "specific example," or "some examples", etc., is meant to incorporate particular features, structures, materials, or characteristics described in combination with the embodiments or the examples into at least one embodiment or example of the present disclosure. In this specification, schematic representations of the above terms do not necessarily refer to the same embodiment or example. Furthermore, the particular features, structures, materials or characteristics described may be combined in any suitable manner in any one or more embodiments or examples.

Although the embodiments of the present disclosure have been shown and described, it will be understood by those of ordinary skill in the art that various changes, modifications, substitutions and variants can be made to these embodiments without departing from the principles and spirit of the present disclosure. The scope of the disclosure is defined by the claims and their equivalents.

What is claimed is:

1. An air conditioner indoor unit comprising:

a surface frame having an air inlet, a first air outlet formed in a front lower part of the surface frame, and at least one second air outlet formed on at least one of a left side and a right side of the surface frame, wherein the first air outlet extends forward through a front part of the surface frame and the first air outlet extends downward through a bottom part of the surface frame;

a breezeless member disposed on a front side of the surface frame and movable between a first position and a second position, the breezeless member comprising a first panel; and a heat exchanger and a fan, disposed in the surface frame, wherein:

the first panel is configured to open the first air outlet when the breezeless member is at the first position, the first panel is configured to cooperate with the surface frame to close the first air outlet when the breezeless member is at the second position, the surface frame has an air outlet channel in communication with both the first air outlet and the at least one second air outlet, a guide portion is formed on a part of a bottom wall of the air outlet channel adjacent to the first air outlet, the guide portion being used to guide airflow towards the first air outlet, in a rear-to-front direction, the guide portion extends obliquely and downward to guide a part of the airflow to a bottom part of the first air outlet, and when the breezeless member is at the second position, the guide portion is opposite to or abuts against a bottom part of the first panel in a front and rear direction.

2. The air conditioner indoor unit according to claim 1, wherein the breezeless member is disposed on the front side of the surface frame and movable up and down between the first position and the second position.

3. The air conditioner indoor unit according to claim 1, wherein, when the breezeless member is at the second position, the first panel has an air dispersing structure formed in an air output portion opposite to the first air outlet.

4. The air conditioner indoor unit according to claim 1, wherein:

the surface frame has a second panel provided on an upper end of the surface frame, the second panel being located on the front side of the surface frame, an accommodating cavity is defined between the second panel and the surface frame, and when the breezeless member is at the second position, at least a part of the first panel is located in the accommodating cavity.

5. The air conditioner indoor unit according to claim 4, wherein the first panel comprises an air output portion having an air dispersing structure and, when the breezeless member is at the second position, the air output portion is opposite to the first air outlet.

6. The air conditioner indoor unit according to claim 1, wherein:

an included angle between the guide portion and a vertical direction ranges from 15° to 60°; and the bottom wall of the air outlet channel has a part thereof on a side of the guide portion away from the first air outlet as a flow guide portion, and the included angle between the guide portion and the vertical direction is smaller than an included angle between the flow guide portion and the vertical direction.

7. The air conditioner indoor unit according to claim 1, wherein:

the surface frame has an air outlet channel in communication with both the first air outlet and the at least one second air outlet, and when the breezeless member is at the first position, a bottom part of the first panel is configured to abut against a top wall of the air outlet channel.

8. The air conditioner indoor unit according to claim 1, further comprising a driving mechanism for driving the breezeless member to move, wherein the driving mechanism comprises:

a motor disposed on a chassis or the surface frame of the air conditioner indoor unit;

a gear connected to an output shaft of the motor; and a rack disposed on the breezeless member and extending in an up and down direction, the rack being configured to engage with the gear.

9. The air conditioner indoor unit according to claim 8, wherein:

the rack is disposed on the first panel, and the rack is detachably connected to the first panel, or the rack is integrally formed with the first panel.

10. The air conditioner indoor unit according to claim 8, wherein:

a first guide rail is disposed on one of the chassis and the breezeless member, and a second guide rail is disposed on the other of the chassis and the breezeless member and is matched with the first guide rail; or the first guide rail is disposed on one of the surface frame and the breezeless member, and the second guide rail is disposed on the other of the surface frame and the breezeless member and is matched with the first guide rail.

11. The air conditioner indoor unit according to claim 10, wherein:

a motor mounting base is disposed on the chassis, the motor is disposed on the motor mounting base, the first guide rail is disposed on the motor mounting base, and the second guide rail is disposed on the rack.

12. The air conditioner indoor unit according to claim 11, wherein:

the motor mounting base has a matching cavity, the matching cavity having a front side that is open, at least a part of the gear is located in the matching cavity, and a part of the rack extends into the matching cavity and engages with the gear, the second guide rail comprises guide grooves formed on a left side wall and a right side wall of the rack, the first guide rail comprises guide protrusions formed on a left side wall and a right side wall of an open end of the matching cavity, and each of the guide protrusions fits in a corresponding one of the guide grooves and is slidable up and down relative to the corresponding guide groove.

13. The air conditioner indoor unit according to claim 8, wherein:

the rack comprises a tooth holder, the tooth holder having a tooth portion and a non-tooth portion on a surface thereof facing towards the gear, the tooth portion extends in an up and down direction and is configured to engage with the gear, and the non-tooth portion is located on at least one side of a length direction of the tooth portion.

14. An air conditioner indoor unit comprising:

a surface frame having an air inlet, a first air outlet formed in a front lower part of the surface frame, and at least one second air outlet formed on at least one of a left side and a right side of the surface frame, wherein the first air outlet extends forward through a front part of the surface frame and the first air outlet extends downward through a bottom part of the surface frame;

a breezeless member disposed on a front side of the surface frame and movable between a first position and a second position, the breezeless member comprising a first panel; and a heat exchanger and a fan, disposed in the surface frame, wherein:

the surface frame has a second panel provided on an upper end of the surface frame, the second panel being located on the front side of the surface frame, an accommodating cavity is defined between the second panel and the surface frame, the first panel is configured to open the first air outlet when the breezeless member is at the first position, the first panel is configured to close the first air outlet when the breezeless member is at the second position, the first panel comprises a non-air output portion and an air output portion that are connected to each other up and down, the air output portion has an air dispersing structure, and the non-air output portion is located above the air output portion; and when the breezeless member is at the second position, the air output portion is opposite to the first air outlet, and the non-air output portion is located in the accommodating cavity.

15. The air conditioner indoor unit according to claim 14, wherein:

the breezeless member comprises an air dispersing module, and the air dispersing module is disposed on the air output portion and located at an inner side of the air output portion;

the air dispersing module comprises a mounting plate having a plurality of first vent holes, the plurality of first vent holes being arranged in a left and right direction, wherein the mounting plate is connected to the first panel; and the air dispersing module further comprises an air dispersing mechanism being disposed at the plurality of first vent holes, the air dispersing mechanism comprising a guide vane assembly disposed in each of the plurality of first vent holes, the guide vane assembly comprising a stationary blade and a rotatable moving blade that are arranged along an axial direction of the first vent hole.

16. The air conditioner indoor unit according to claim 15, wherein:

the moving blade is disposed on a front side or a rear side of the stationary blade; and/or the moving blade and the stationary blade are disposed coaxially.

17. The air conditioner indoor unit according to claim 15, wherein:

the air dispersing module comprises a limit plate connected to the first panel, and the limit plate is disposed on a front side of the mounting plate and is connected to the mounting plate, the limit plate has second vent holes, the second vent holes being opposite to and in communication with the plurality of first vent holes, and an accommodating cavity is defined between the mounting plate and the limit plate and is configured to accommodate the air dispersing mechanism.

18. The air conditioner indoor unit according to claim 5, wherein the air output portion comprises a first sub air output portion and a second sub air output portion that are connected to each other up and down, and each of the first sub air output portion and the second sub air output portion has the air dispersing structure, an included angle is defined between the first sub air output portion and the second sub air output portion, and when the breezeless member is at the second position, the first sub air output portion is located on a front side of the first air outlet, and the second sub air output portion is located at a bottom part of the first air outlet.

19. The air conditioner indoor unit according to claim 18, wherein:

the included angle between the first sub air output portion and the second sub air output portion ranges from 60° to 120°; or an air dispersing module is disposed on the first sub air output portion.

20. An air conditioner indoor unit comprising:

a surface frame having an air inlet, a first air outlet formed in a front lower part of the surface frame, and at least one second air outlet formed on at least one of a left side and a right side of the surface frame, wherein the first air outlet extends forward through a front part of the surface frame and the first air outlet extends downward through a bottom part of the surface frame;

a breezeless member disposed on a front side of the surface frame and movable between a first position and a second position, the breezeless member comprising a first panel; and a heat exchanger and a fan, disposed in the surface frame, wherein:

the surface frame has an air outlet channel in communication with both the first air outlet and the at least one second air outlet, a rotatable inner air guide plate is provided in the air outlet channel, the first panel is configured to open the first air outlet when the breezeless member is at the first position, the first panel is configured to close the first air outlet when the breezeless member is at the second position, and when the breezeless member is at the first position, a length of the inner air guide plate in the air outlet direction of the first air outlet is L1, and when the breezeless member is at the second position, the length of the inner air guide plate in the air outlet direction of the first air outlet is L2, wherein L2 is smaller than L1.

21. The air conditioner indoor unit according to claim 20, wherein:

the air conditioner indoor unit has a heating mode and a cooling mode;

when the breezeless member is at the first position and the air conditioner indoor unit is in the cooling mode, an included angle between the inner air guide plate and a horizontal plane ranges from 0 to 45°; and when the breezeless member is at the first position and the air conditioner indoor unit is in the heating mode, the included angle between the inner air guide plate and the horizontal plane ranges from 45° to 90°.

22. The air conditioner indoor unit according to claim 20, wherein the inner air guide plate comprises:

a first sub inner air guide plate rotatably connected to an inner wall of the air outlet channel;

a second sub inner air guide plate slidable disposed on the first sub inner air guide plate and configured to adjust the length of the inner air guide plate in the air outlet direction of the first air outlet; and the first sub inner air guide plate has a sliding cavity, the second sub inner air guide plate being slidably disposed in the sliding cavity.

* * * * *